US005695040A

United States Patent [19]

Watanabe et al.

[11] Patent Number: 5,695,040

[45] Date of Patent: Dec. 9, 1997

[54] ESCALATOR STEP

[75] Inventors: Keiichi Watanabe, Tomisato-machi; Syuichi Fujieda, Natita, both of Japan

[73] Assignee: Otis Elevator Company, Farmington, Conn.

[21] Appl. No.: 263,870

[22] Filed: Jun. 21, 1994

[30] Foreign Application Priority Data

Jun. 24, 1993 [JP] Japan ..... 5-34216 U

[51] Int. Cl.[6] ..... B66B 23/12

[52] U.S. Cl. ..... 198/333

[58] Field of Search ..... 198/333, 496–498

[56] References Cited

U.S. PATENT DOCUMENTS 4,397,383 8/1983 James ..... 198/333

5,042,641 8/1991 Soldat ..... 198/333

5,082,102 1/1992 Reichmuth ..... 198/333

FOREIGN PATENT DOCUMENTS 0386512 2/1990 European Pat. Off. ..... B66B 29/02

82/04240 12/1982 WIPO ..... B66B 9/12

OTHER PUBLICATIONS

European Search Report dated 17 Mar. 1995.

*Primary Examiner*—Joseph E. Valenza

[57] ABSTRACT

A step for a passenger conveying device is provided, comprising a tread portion, a riser portion, and a plurality of blocking members. The tread portion includes a width, a length, and a pair of end faces extending along its width. Each of the tread portion end faces includes a slot. The blocking members are received within the slots.

12 Claims, 3 Drawing Sheets

ESCALATOR STEP

BACKGROUND OF THE INVENTION

1. Technical Field

This invention relates to passenger conveying device steps in general, and to escalator steps in particular.

2. Background Information

Escalators and other passenger conveying devices typically include a frame, a drive, a pair of balustrades, a step chain, and a plurality of steps attached to the step chain. The frame comprises a truss section on both the left and right hand sides of the frame. In the case of an escalator, each truss section has two end sections parallel to one another, connected by an inclined midsection. The end sections form landings at the two elevations connected by the midsection, one on each end. Matching pairs of roller tracks are attached on the inside of each truss section, i.e. the side of the truss section facing the other truss section. The balustrades, comprising handrails, skirt panels, and balustrade panels, are attached to the truss sections as is known in the art.

The step chain consists of a pair of chain strands, a plurality of rollers, and a plurality of connecting axles for connecting the two chain strands as is known in the art. The step chain is driven by the drive, typically through a sprocket assembly, along a circuitous path. The path is defined by the roller tracks extending between the first and second landings.

The plurality of steps attach to the connecting axles of the step chain. Each step comprises a tread portion and a riser portion. The tread portion comprises a width, a length, and a pair of end faces extending along the width of the tread portion. The riser section comprises a width, a length, and a pair of end faces extending along the width of the riser section.

In the exposed portion of the step chain path, the steps travel from one landing to the other roughly centered between the skirt panels of the balustrades. A person of skill in the art will recognize that it is necessary to have a clearance space between the end faces of each step and the adjacent skirt panel. A person of skill in the art will also recognize that these clearance spaces present potential pinch points where foreign objects such as clothing and shoe heels can become lodged. To prevent such an occurrence, it is known in the art to adhere a brush to the end faces of a step. One difficulty with that solution is that the brushes typically break free in a short period of time. Another difficulty is the task of adhering the brushes to the step end faces.

DISCLOSURE OF THE INVENTION

It is, therefore, an object of the present invention to provide a means for preventing foreign objects from becoming lodged between the step of a passenger conveyor and the adjacent balustrade.

Another object of the invention is to provide a durable means for preventing foreign objects from becoming lodged between the step of a passenger conveyor and the adjacent balustrade.

Still another object of the invention is to provide an easily installed means for preventing foreign objects from becoming lodged between the step of a passenger conveyor and the adjacent balustrade.

According to the present invention, a step for a passenger conveying device is provided, comprising a tread portion, a riser portion, and a plurality of blocking members. The tread portion includes a width, a length, and a pair of end faces extending along its width. Each of the tread portion end faces includes a slot. The blocking members are received within the slots.

According to one aspect of the present invention, the riser portion includes a width, a length, and a pair of end faces extending along its width. Each of the riser portion end faces includes a slot. The blocking members are received within the slots.

In one embodiment of the present invention, the blocking members comprise a brush.

In another embodiment of the present invention, the blocking members comprise a wiper.

An advantage of the present invention is that the blocking members are durable. A person of skill in the art will recognize that durable blocking members not only decrease maintenance costs, but also increase the safety of the device because they are less apt to fail and provide an opportunity for a foreign object to become wedged.

Another advantage of the present invention is that the blocking members are easily installed. A person of skill in the art will recognize that an easily installed blocking member decreases both installation and maintenance costs.

These and other objects, features and advantages of the present invention will become more apparent in light of the detailed description of the best mode embodiment thereof, as illustrated in the accompanying drawings.

BEST MODE FOR CARRYING OUT THE INVENTION

Figure 1:
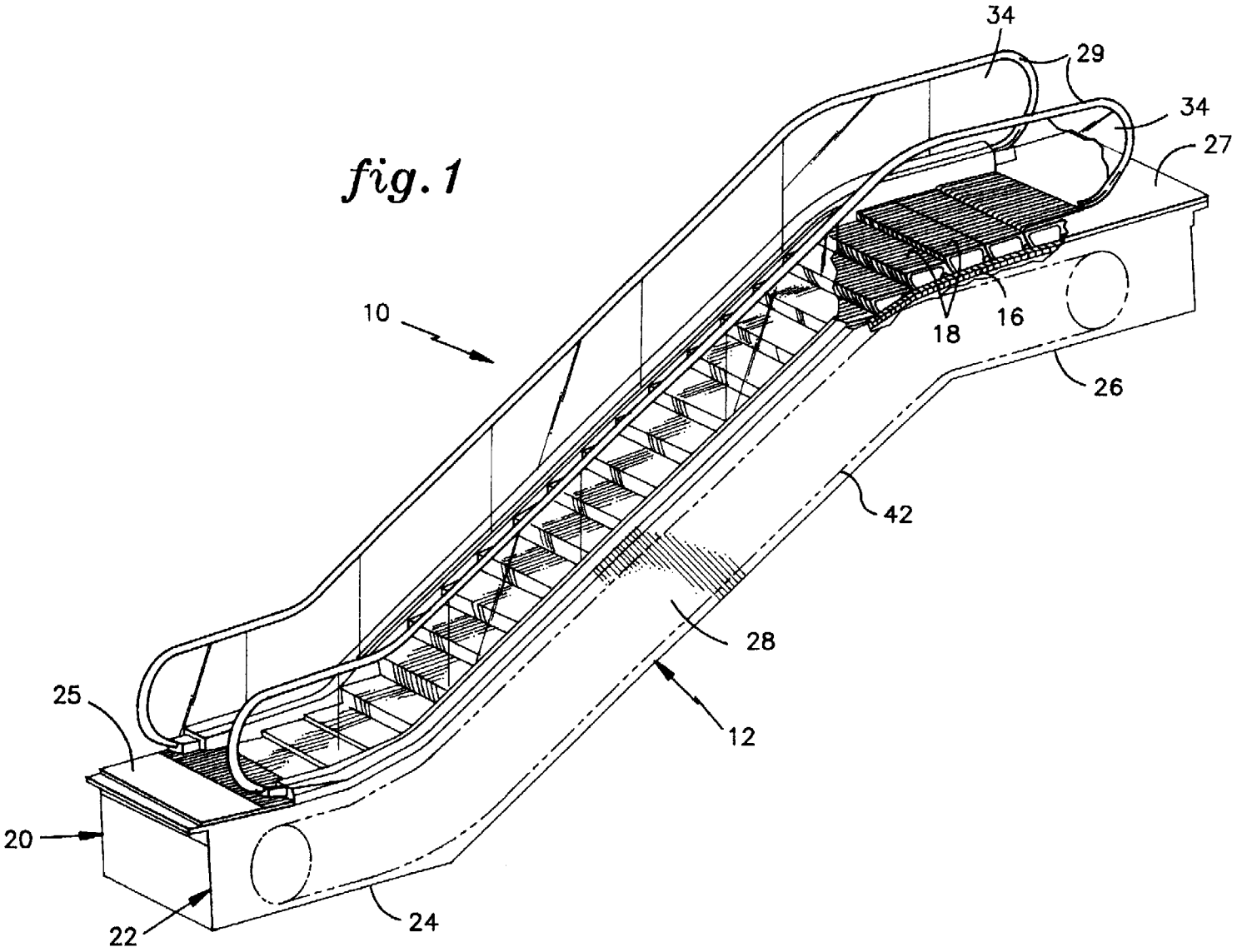
FIG. 1 shows a partial view of an escalator.
Figure 2:
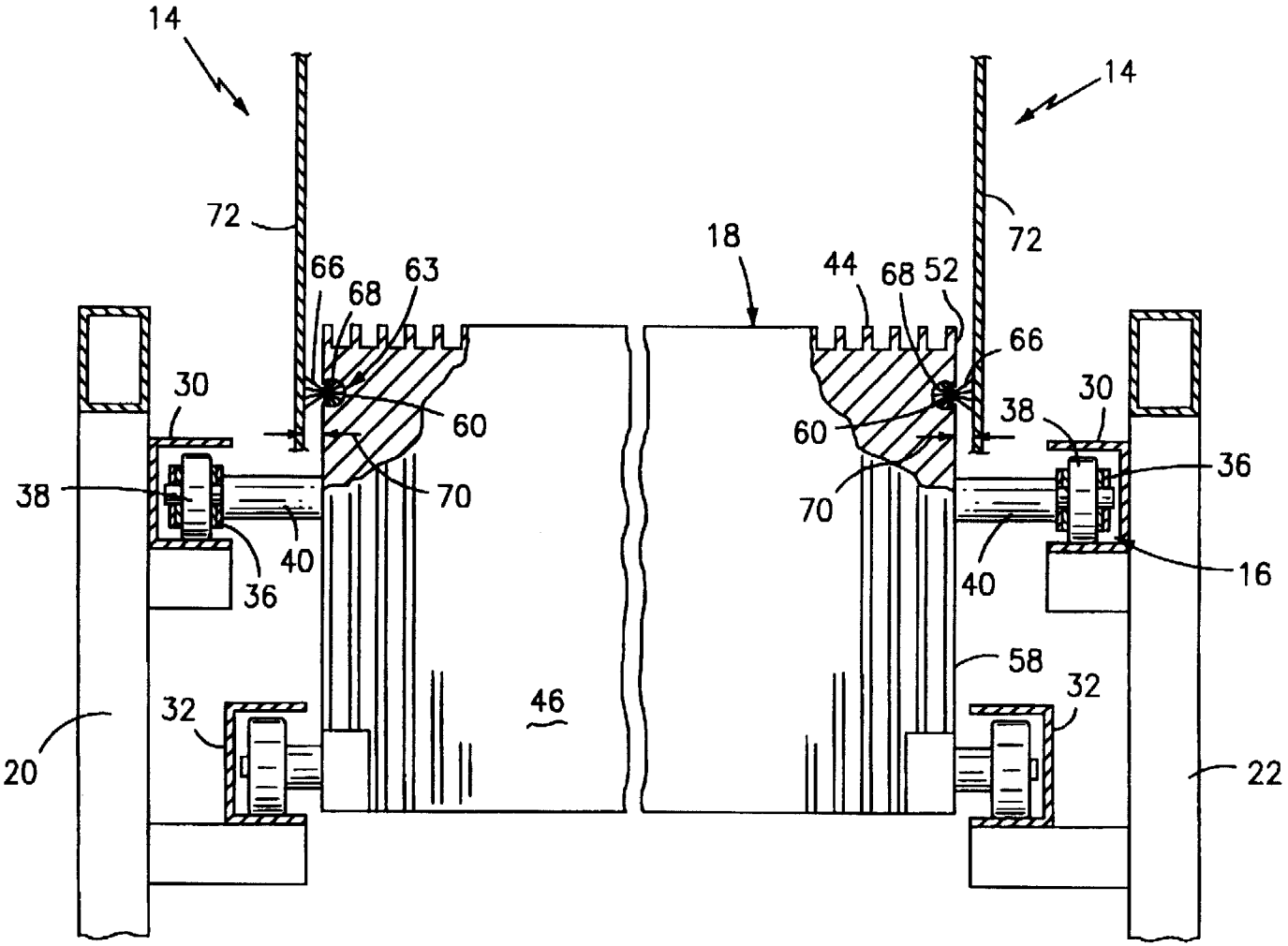
FIG. 2 is a diagrammatic sectional view of an escalator.

Referring to FIG. 1, an escalator 10 includes a frame 12, a drive (not shown), a pair of balustrades 14, a step chain 16, and a plurality of steps 18 attached to the step chain 16. The frame 12 comprises a truss section 20,22 on both the left and right hand sides of the frame (see FIG. 2), respectively. Each truss section 20,22 has two end sections 24,26 parallel to one another, connected by an inclined midsection 28. The end sections 24,26 form landings 25,27 at the two elevations. Matching pairs of roller tracks 30,32, as shown in FIG. 2, are attached on the inside of each truss section 20,22, i.e. the side of the truss section facing the other truss section. The balustrades 14, comprising handrails 29, skirt panels 72, and balustrade panels 34 are attached to the truss sections 20,22 as is known in the art.

Figure 3:
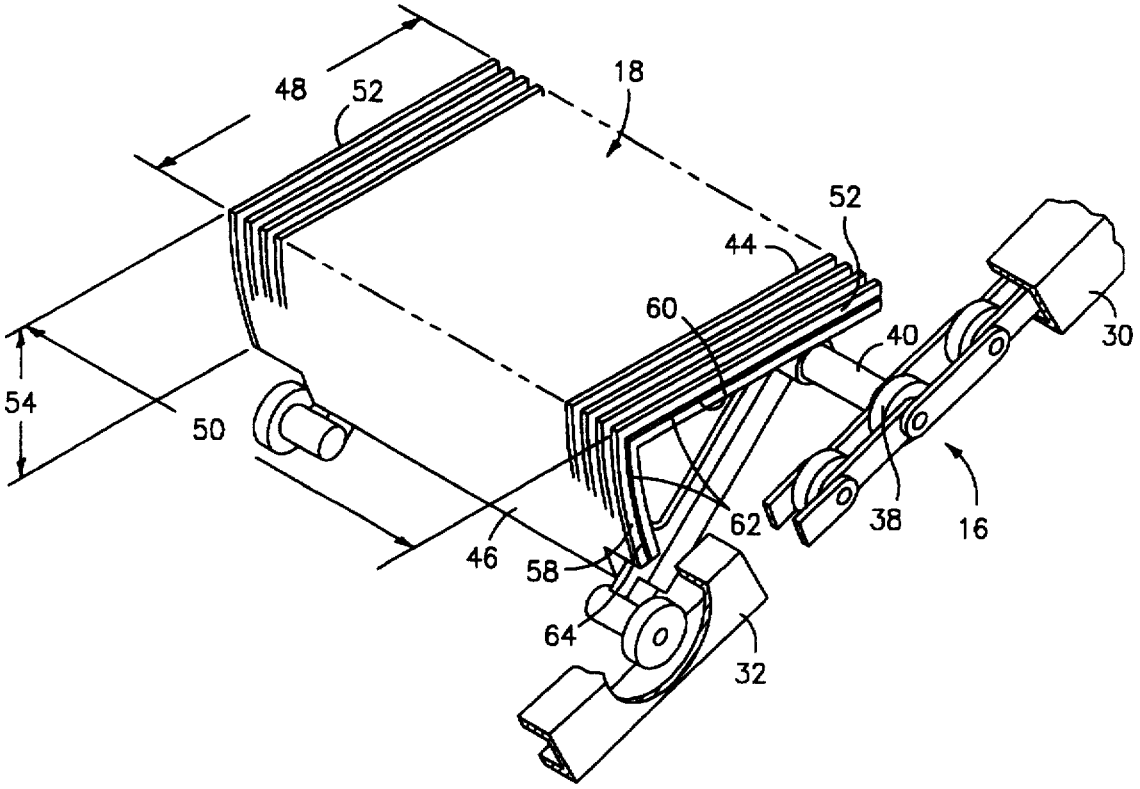
FIG. 3 is a diagrammatic perspective view of an escalator step attached to a section of step chain.

Referring to FIGS. 2 and 3, the step chain 16 consists of a pair of chain strands 36, a plurality of rollers 38, and a plurality of connecting axles 40 for connecting the two chain strands 36 as is known in the art. The step chain 16 is driven by the drive, typically through a sprocket assembly, along a circuitous path 42 (shown in phantom—see FIG. 1). The path 42 is defined by the roller tracks 30,32 extending between the first 25 and second 27 landings (see FIG. 1).

The plurality of steps 18, as shown in FIG. 3, attach to the connecting axles 40 of the step chain 16. Each step 18 comprises a tread portion 44 and a riser portion 46. The tread portion 44 comprises a width 48, a length 50, and a pair of end faces 52 extending along the width 48 of the tread portion 44. The riser portion 46 comprises a width 54, a length 50 (common to that of the tread portion 44), and a pair of end faces 58 extending along the width 54 of the riser portion 46. The end faces 58 extending along the width 48 of the tread portion 44 include a slot 60 for receiving a blocking member 62. The end faces 58 extending along the width 54 of the riser portion 46 may also include a slot 64 for receiving a blocking member 62.

Figure 4:
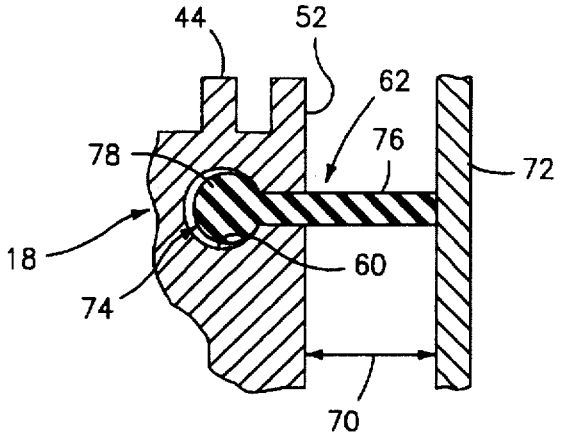
FIG. 4 is a diagrammatic view of a blocking member.

Referring to FIG. 2, in one embodiment, the blocking member 62 comprises a brush 63 having bristles 66 and a shank section 68. The slot 60 along the tread portion 44 and/or the slot 64 along the riser portion 46 (see FIG. 3) receives the shank section 68 and thereby secures the brush 63 to the step 18. The brush bristles 66 are sized to extend across the clearance space 70 between the end face 52,58 and the adjacent skin panel 72. In another embodiment, as shown in FIG. 4, the blocking member 62 comprises a wiper 74 having a blade 76 and a shank section 78. The slot 60 along the tread portion 44 and/or the slot 64 along the riser portion 46 (see FIG. 3) receives the shank section 78 and thereby secures the wiper 74 shaped blocking member 62 to the step 18. The wiper blade 76 is sized to extend across the clearance space 70 between the end face 52,58 and the adjacent skirt panel 72. The slot 60,64 and the shank section 68,78 of each blocking member 62 forms a mating male and female pair which prevents the blocking member 62 from being pulled from the slot 60,64.

Referring to FIGS. 1 and 2, in the operation of the escalator, the step chain 16 is driven in its circuitous path 42 from one landing 25,27 to the other. In the exposed portion of that path 42, the steps 18 travel between the skirt panels 72 of the balustrades 14. The steps 18 are roughly centered between the skirt panels 72, thereby leaving a clearance space 70 between the end faces 52,58 of each step 18 and the adjacent skin panel 72. The blocking members 62 extend across these clearance spaces 70 and thereby prevent foreign objects from becoming lodged between the steps 18 and the skin panels 72.

Although this invention has been shown and described with respect to the detailed embodiments thereof, it will be understood by those skilled in the art that various changes in form and detail thereof may be made without departing from the spirit and scope of the claimed invention. For example, a step for a passenger conveying device other than an escalator may include a blocking member attached in the manner described heretofore.

We claim:

1. An escalator step, comprising:

a tread portion, having a width, a length, and a pair of end faces extending along said width of said tread portion, wherein each of said end faces includes a slot;

a riser portion, attached to said tread portion along said length of said tread portion; wherein said riser portion further comprises:

a width and a length; and a pair of end faces, extending along said width of said riser portion, wherein each of said end faces includes a slot; and a plurality of blocking members, wherein each of said slots within said tread portion and riser portion end faces receives one of said blocking members;

wherein said slots and said blocking members comprise mating male and female geometries.

2. An escalator step according to claim 1, wherein said blocking member comprises a brush having a plurality of bristles and a shank, wherein said shank is received within said slot.

3. An escalator step according to claim 1, wherein said blocking member comprises a wiper having a blade and a shank, wherein said shank is received within said slot.

4. An escalator, comprising:

a frame;

a step chain;

a drive, for driving said step chain in a circuitous path about said frame;

a pair of balustrades, wherein one of said balustrades is attached to said frame adjacent one side of said step chain, and the other of said balustrades is attached to said frame adjacent the other side of said frame;

a plurality of steps, attached to said step chain, wherein each of said steps comprises:

a tread portion, having a width, a length, and a pair of end faces extending along said width of said tread portion, wherein each of said end faces includes a slot;

a riser portion, attached to said tread portion along said length of said tread portion wherein said riser portion further comprises:

a width and a length; and a pair of end faces, extending along said width of said riser portion, wherein each of said end faces includes a slot; and a plurality of blocking members, wherein each of said slots within said tread portion and riser portion end faces receives one of said blocking members;

wherein said slots and said blocking members comprise mating male and female geometries, wherein said blocking members extend within clearance spaces between said steps and said balustrades, and thereby prevent foreign objects from entering between said steps and said balustrades.

5. An escalator according to claim 4, wherein said blocking member comprises a brush having a plurality of bristles and a shank, wherein said shank is received within said slot.

6. An escalator according to claim 4, wherein said blocking member comprises a wiper having a blade and a shank, wherein said shank is received within said slot.

7. A passenger conveying device, comprising:

a frame;

a step chain;

a drive, for driving said step chain in a circuitous path about said frame;

a pair of balustrades, wherein one of said balustrades is attached to said frame adjacent one side of said step chain, and the other of said balustrades is attached to said frame adjacent the other side of said frame;

a plurality of steps, attached to said step chain, wherein each of said steps comprises:

a tread portion, having a width, a length, and a pair of end faces extending along said width of said tread portion, wherein each of said end faces includes a slot;

a riser portion, attached to said tread portion along said length of said tread portion wherein said riser portion further comprises:

a width and a length; and a pair of end faces, extending along said width of said riser portion, wherein each of said end faces includes a slot; and a plurality of blocking members, wherein each of said slots within said tread portion end faces receives one of said blocking members;

wherein said slots and said blocking members comprise mating male and female geometries, wherein said blocking members extend within clearance spaces between said steps and said balustrades, and thereby prevent foreign objects from entering between said steps and said balustrades.

8. A passenger conveying device according to claim 7, wherein said blocking member comprises a brush having a plurality of bristles and a shank, wherein said shank is received within said slot.

9. A passenger conveying device according to claim 7, wherein said blocking member comprises a wiper having a blade and a shank, wherein said shank is received within said slot.

10. A step for a passenger conveying device, comprising:

a tread portion, having a width, a length, and a pair of end faces extending along said width of said tread portion, wherein each of said end faces includes a slot;

a riser portion, attached to said tread portion along said length of said tread portion wherein said riser portion further comprises:

a width and a length; and a pair of end faces, extending along said width of said riser portion, wherein each of said end faces includes a slot; and a plurality of blocking members, wherein each of said slots within said tread portion end faces receives one of said blocking members;

wherein said slots and said blocking members comprise mating male and female geometries.

11. A step for a passenger conveying device according to claim 10, wherein said blocking member comprises a brush having a plurality of bristles and a shank, wherein said shank is received within said slot.

12. A step for a passenger conveying device according to claim 10, wherein said blocking member comprises a wiper having a blade and a shank, wherein said shank is received within said slot.

* * * * *